US006845313B2

(12) United States Patent
Hasegawa et al.

(10) Patent No.: US 6,845,313 B2
(45) Date of Patent: Jan. 18, 2005

(54) ENGINE START CONTROL METHOD AND DEVICE

(75) Inventors: Hitoshi Hasegawa, Shizuokai-ken (JP); Yuuichirou Sawada, Shizuoka-ken (JP); Michiyasu Takahashi, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/477,169

(22) PCT Filed: Oct. 22, 2002

(86) PCT No.: PCT/JP02/10914

§ 371 (c)(1),
(2), (4) Date: Apr. 29, 2004

(87) PCT Pub. No.: WO03/036079

PCT Pub. Date: May 1, 2003

(65) Prior Publication Data

US 2004/0186656 A1 Sep. 23, 2004

(30) Foreign Application Priority Data

Oct. 24, 2001 (JP) ..... 2001-326420

(51) Int. Cl.[7] ..... F02N 15/00; F02N 11/08; F02D 41/06

(52) U.S. Cl. ..... 701/113; 123/179.24

(58) Field of Search ..... 701/113, 115; 123/179.24, 179.3

(56) References Cited

U.S. PATENT DOCUMENTS 6,561,151 B1 * 5/2003 Wisnia et al. ..... 123/179.3

FOREIGN PATENT DOCUMENTS

| | | | | |
|---|---|---|---|---|
| JP | 6-167263 | | 6/1994 | |
| JP | 11-190265 A | * | 7/1999 | ..... F02D/45/00 |
| JP | 2001-82299 | | 3/2001 | |
| JP | 2002-155838 A | * | 5/2002 | ..... F02N/11/08 |
| JP | 2002-206466 | | 7/2002 | |

* cited by examiner

*Primary Examiner*—Hieu T. Vo
(74) *Attorney, Agent, or Firm*—Hogan & Hartson, LLP

(57) ABSTRACT

There is provided an engine start control method and an engine start control apparatus which can judge cell starting and kick starting with a simple constitution to perform optimum engine start according the respective starting.

The engine start control method and the engine start control apparatus have a cell starting program at the time when an engine is started by a cell motor and a human power starting program at the time when the engine is started by a human power, detect a difference between a battery voltage at the time of engine stop and a battery voltage at the time of commencement of engine start, and starts the engine in accordance with the cell starting program if this difference is larger than a predetermined value and starts the engine in accordance with the human power starting program if the difference is smaller than the predetermined value.

3 Claims, 8 Drawing Sheets

ENGINE START CONTROL METHOD AND DEVICE

TECHNICAL FIELD

The present invention relates to an engine start control method and an engine start control apparatus, and in particular to a judgment method and a judgment apparatus for starting means therefor.

BACKGROUND ART

In a motorcycle, it is possible to start an engine with cell starting by a cell motor starter receiving an electric power from a battery and kick starting by a kick pedal which a driver presses with a foot. At the cranking time of a fuel injection engine, an optimum amount of fuel injection and an optimum ignition time are different in the case of the cell starting and in the case of the kick starting. The engine is provided with an ECU (engine control unit), and in response to a driving state, the ECU adjusts an amount of fuel injection and an ignition time to an optimum state in accordance with a program according to a map or the like decided in advance and controls to drive the engine. At the time of commencement of engine start, a detection device (circuit) is provided in a starter switch between the battery and the cell motor, and the ECU detects whether or not the cell motor has been driven according to a signal from this detection device to judge whether the engine is started by the cell starting or the kick starting. According to the judgment, the ECU can select a program to perform driving control at the time of commencement of engine start.

However, the detection device of the starter switch may not be provided in the case in which a restriction in terms of space is large, in particular, in a small motorcycle or the like and a structure thereof is desired to be simplified, the case in which cost is desired to be reduced, or the like. In such a case, a program is set according to a map or the like matched to one of the cell starting or the kick starting, and the driving control at the time of commencement of engine start is performed using the same program in both the cell starting and the kick starting without any distinction.

Consequently, it is likely that, in the case of the cell starting or the kick starting, the engine cannot be driven with an optimum amount of fuel injection and at an optimum ignition time to decrease startability and deteriorate exhaust gas emission.

The present invention has taken into account the above-mentioned related art, and it is an object of the present invention to provide an engine start control method and an engine start control apparatus which can distinguish cell starting and kick starting with a simple constitution without using a detection device of a starter switch to perform optimum engine start according to the respective starting.

DISCLOSURE OF THE INVENTION

In order to attain the above-mentioned object, in the present invention, there is provided an engine start control method, comprising: a cell starting program at the time of starting an engine with a cell motor; and a human power start program at the time of starting an engine with a human power, characterized in that the engine start control method detects a difference between a battery voltage at the time of engine stop and a battery voltage at the time of commencement of engine start, starts the engine in accordance with the cell starting program if this difference is larger than a predetermined value, and starts the engine in accordance with the human power start program if the difference is smaller than the predetermined value.

According to this constitution, it is possible to judge whether the engine is to be started by the cell stating or the kick starting according to a difference of battery voltage drop at the time when a cell motor is used at the time of commencement of engine start and at the time of the kick starting, and select the cell starting program and the kick starting program according to this judgment to perform optimum engine start control in the respective cases.

A preferred example of constitution is characterized in that the engine start control program detects the battery voltage at the time of engine stop in a state before engine rotation to save the battery voltage, detects the battery voltage at the time of commencement of engine start when a crank pulse signal after engine rotation is equal to or lower than a predetermined number of pulses to save the battery voltage, and controls to drive the engine based upon a difference of the saved battery voltage data when the crank pulse signal has reached the predetermined pulse or more.

According to this constitution, a battery voltage is detected in a state when a fuel pump is driven for high pressurization of fuel before engine rotation and saved as a voltage at the time of engine stop which is one voltage for calculating a difference of a battery voltage, and a battery voltage is detected after engine rotation in a state in which a crank pulse signal is equal to or lower than a predetermined number of pulses and saved as a voltage at the time of commencement of engine start which is the other voltage for calculating the difference. When the engine is started and comes into a state in which a stable crank pulse is obtained, the saved battery voltage at the time of engine stop and the saved battery voltage at the time of commencement of engine start are compared to judge whether the engine is started by cell staring or kick starting. Note that, when the battery voltage at the time of commencement of engine start is saved, the battery voltage may be simultaneously compared with the battery voltage at the time of engine stop to judge whether the engine is started by the cell starting or the kick starting to save a result of the judgment. Consequently, engine start can be controlled based upon the result of the judgment immediately after the engine rotates steadily.

In the present invention, as an apparatus for carrying out the engine start control method, there is provided an engine start control apparatus for a fuel injection engine, comprising: a battery; a cell motor which is driven by an electric power from the battery; an injector for fuel injection; a fuel pump which supplies fuel to the injector; an ECU which controls to drive the engine at the time of commencement of engine start; a main switch intervened between the ECU and the battery; and a cell switch which drives the cell motor, a crank pulse signal being inputted to the ECU in accordance with engine rotation, and the ECU calculating an engine speed based upon this crank pulse after the crank pulse signal has exceeded a predetermined number of crank pulses after start of the engine rotation, the fuel pump being driven after the main switch is turned ON and before the engine rotation, and the ECU having a cell starting program at the time of starting the engine with the cell motor and a human power start program at the time of starting the engine with a human power, characterized in that the ECU judges whether the engine is to be started by the cell motor or a human power based upon the battery voltage to selectively use the cell starting program and the human power start program.

According to this constitution, in a fuel injection engine, by an ECU thereof, a battery voltage before engine rotation is detected and saved as a voltage at the time of engine stop which is one voltage for calculating a difference of battery voltages, and a battery voltage is detected after engine rotation in a state in which a crank pulse signal is equal to or lower than a predetermined number of pulses before the crank pulse signal is stabilized and saved as a voltage at the time of commencement of engine start which is the other voltage, and when the engine is started and comes into a state in which a stable crank pulse is obtained, the engine can be controlled to start based upon a result of judgment on whether the engine is started by cell starting or kick starting according to comparison of the saved battery voltage at the time of engine stop and the saved battery voltage at the time of commencement of engine start.

BEST MODE FOR CARRYING OUT THE INVENTION

An embodiment of the present invention will be hereinafter described with reference to the drawings.

Figure 1:
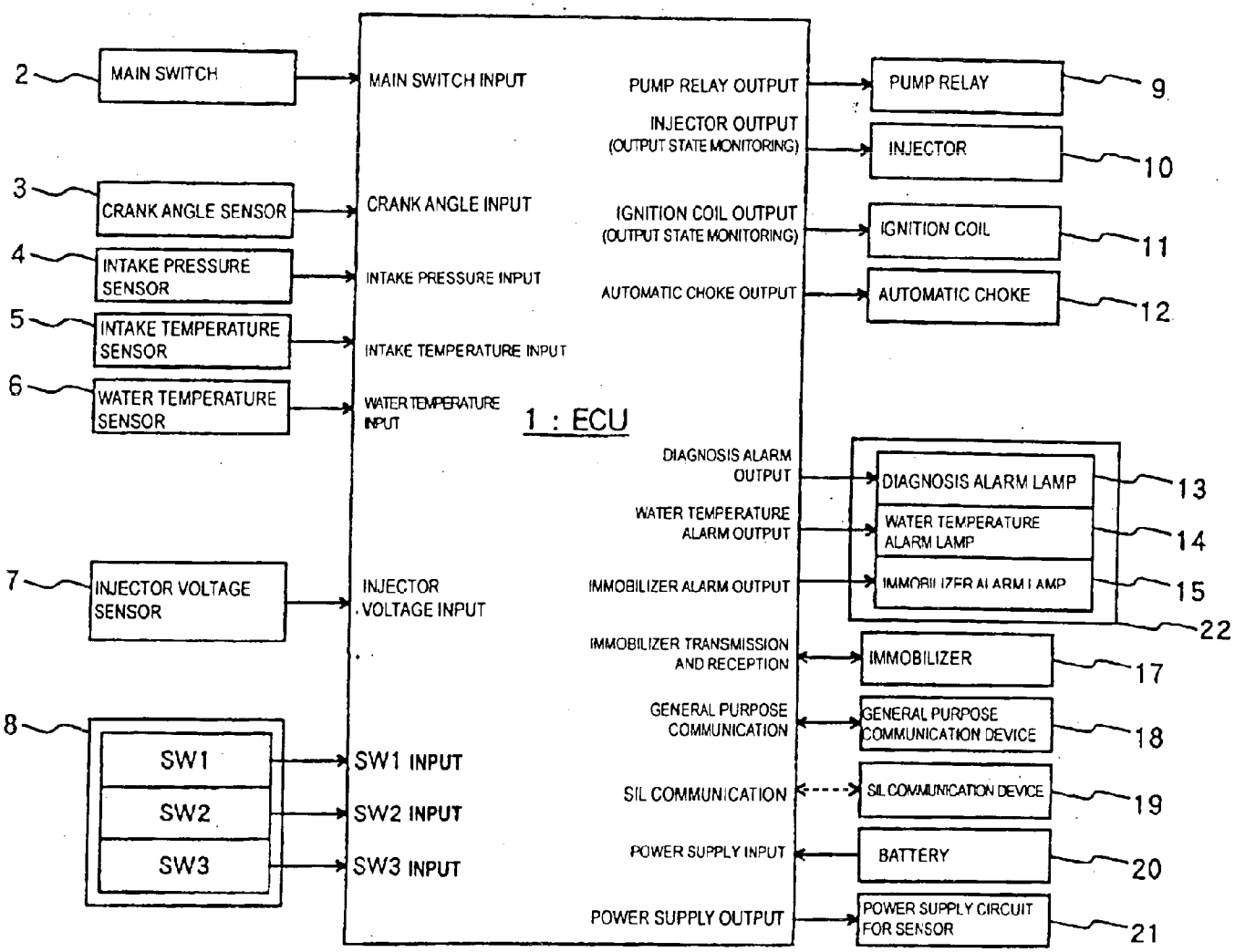
FIG. 1 is a block diagram of an entire engine control system in accordance with the present invention.

FIG. 1 is a block diagram of an entire control system for a motorcycle in accordance with the embodiment of the present invention.

As inputs to a control circuit CPU (not shown) for an engine control unit (ECU) 1 which is unitized as an integral component, an ON/OFF signal from a main switch 2, a crank pulse signal from a crank angle sensor 3, an intake pressure detection signal from an intake pressure sensor 4, an intake temperature detection signal from an intake temperature sensor 5, a cooling water temperature detection signal from a water temperature sensor 6, a voltage signal for injector control from an injector voltage sensor 7, and input signals for inspection from a switch box 8 having plural switches SW1 to SW3 are inputted. In addition, a battery 20 is connected and a battery power supply is inputted to the control circuit CPU.

As outputs from the ECU 1, a pump relay output signal to a pump relay 9 for driving a fuel pump, an injector output signal for driving a magnet coil of an injector 10, an ignition coil output signal for driving an ignition coil 11, an automatic choke output signal for driving an automatic choke 12 according to a cooling water temperature, a diagnosis alarm signal for driving a diagnosis alarm lamp 13 in a meter 22 when an abnormal state is detected, a water temperature alarm signal for driving a water temperature alarm lamp 14 which displays an alarm when the cooling water temperature has exceeded a predetermined temperature, and an immobilizer alarm signal for driving an immobilizer alarm lamp 15 when an immobilizer 17 such as an engine key is operated unusually are outputted. In addition, a power supply voltage, which supplies an electric power via a power supply circuit for sensor 21 or directly, is outputted to the respective sensors.

In addition, the ECU 1 is connected to a general purpose communication device 18 in the outside and is capable of inputting and outputting control data or the like via a general purpose communication line. Moreover, the ECU 1 is connected to a serial communication device 19 and is capable of performing serial communication.

Figure 2:
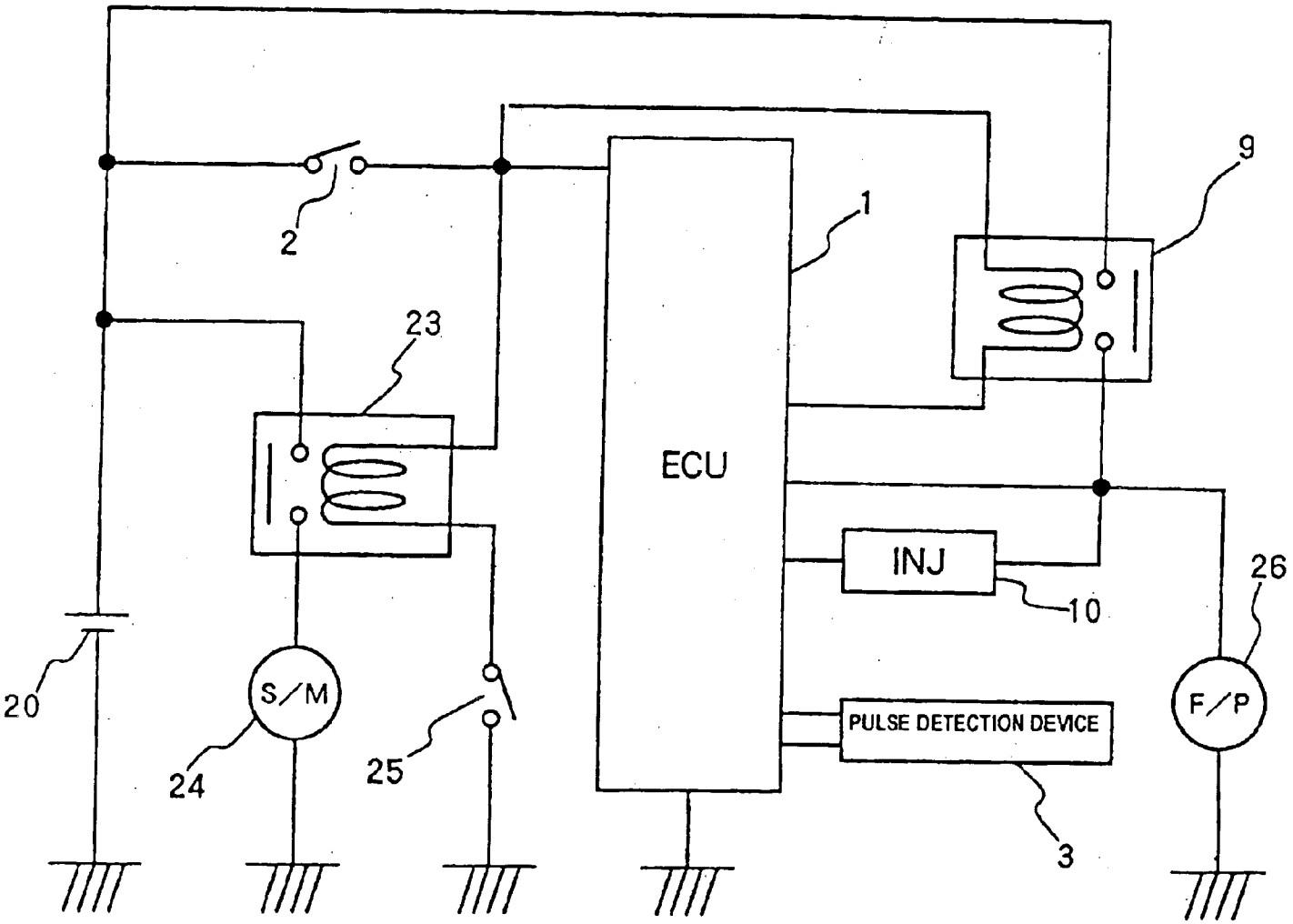
FIG. 2 is a diagram of an engine start control apparatus in accordance with the present invention.

FIG. 2 is an explanatory diagram of a structure of an engine start control apparatus for a motorcycle provided with a fuel injection engine in accordance with the present invention.

The battery 20 is connected to the ECU 1 via the main switch 2. A cell motor 24 and a cell switch 25 are connected to the ECU 1 via a starter relay 23. A fuel pump 26 and the injector 10 are further connected to the ECU 1 via the pump relay 9. In addition, the pulse detection device (crank angle sensor) 3 for detecting rotation of an engine (not shown) is connected to the ECU 1. This pulse detection device 3 detects plural projections provided on a circumference of a crankshaft of the engine, and sends a crank pulse signal corresponding to each projection to the ECU 1 in accordance with the rotation of the crankshaft.

Figure 3:
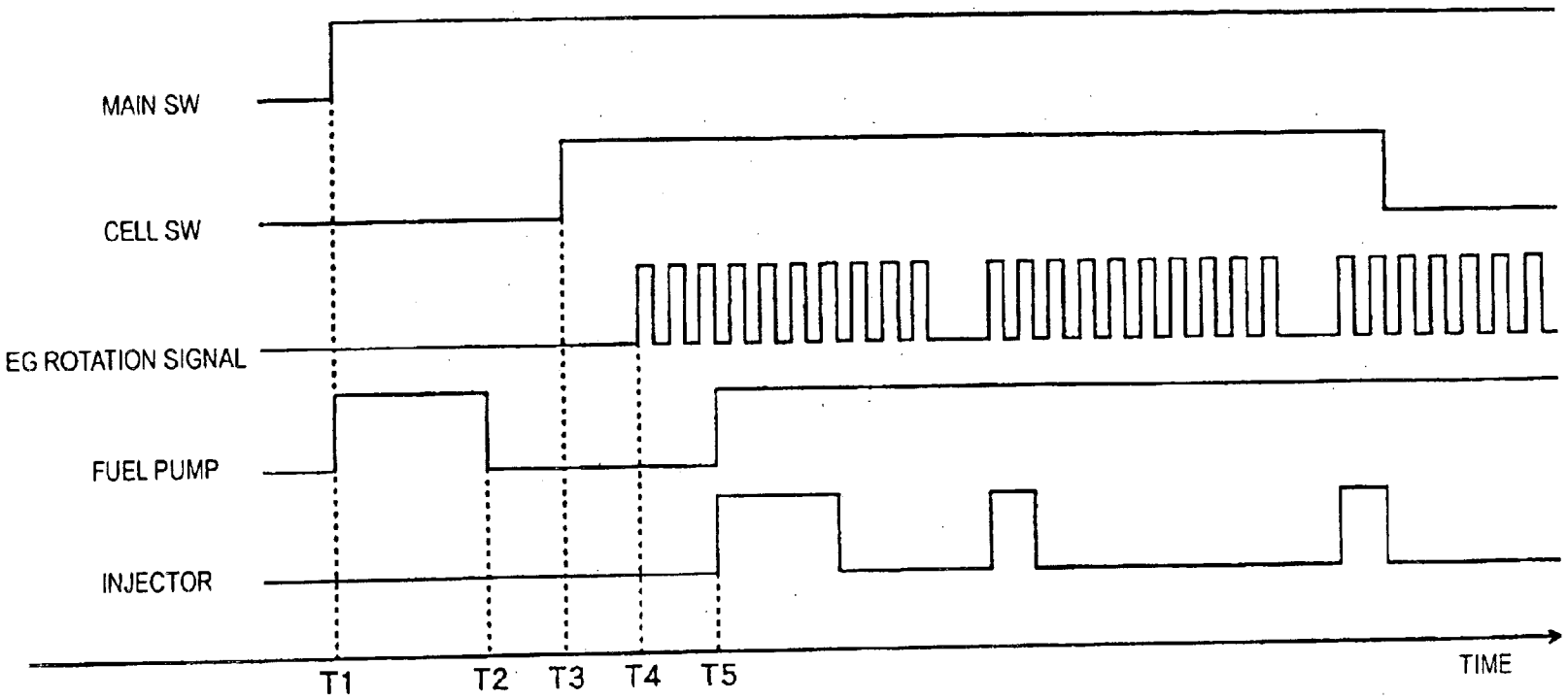
FIG. 3 is a time chart showing an operation of the engine start control apparatus of FIG. 2.

FIG. 3 is a time chart showing an operation of the engine start control apparatus of FIG. 2.

In the case in which the engine is started, first, the main switch 2 is turned ON (time T1). When an ON signal of this main switch 2 is inputted to the ECU 1, the ECU 1 preliminarily drives the fuel pump 26 via the pump relay 9 for a predetermined time (e.g., a few seconds to T2) to increase a fuel pressure to a predetermined pressure. When the cell switch 25 is turned ON by a driver (time T3), the cell switch 25 is turned ON via the starter relay 23, and the engine starts to rotate. After the rotation is started, the pulse detection device 3 detects the projection of the crankshaft and emits a crank pulse signal to the ECU 1 (time T4). In this case, a pulse width or an interval of a first few pulse signals is large because the rotation is actually slow. In addition, the pulse width or the interval is irregular because the rotation is unstable.

When several crank pulse signals (e.g., three to five pulses) have been sent and the engine rotation has been stabilized, at time T5, the ECU 1 activates the fuel pump 26 again, and at the same time, drives the injector 10 to inject the fuel and excites the ignition coil 11 (FIG. 1) to rotate the engine with self-explosion.

In the present invention, after the main switch 2 is turned ON, the ECU 1 detects a battery voltage between time T1 and time T2 during driving of the fuel pump 26 before the crankshaft rotates, and saves this data as a battery voltage at the time of engine stop. In addition, after a crank pulse signal is commenced to be sent (time T4) and several unstable crank pulse signals (e.g., three to five pulses) are sent, the ECU 1 detects a battery voltage until time T5 when the engine is commenced to be driven, and saves this data as a battery voltage at the time of commencement of engine rotation. By comparing these two battery voltages, the ECU 1 distinguishes the cell starting and the kick starting to perform engine drive control at the starting time as described later. Note that, in the case of the kick starting, the cell switch of the time chart is kept OFF.

Figure 4:
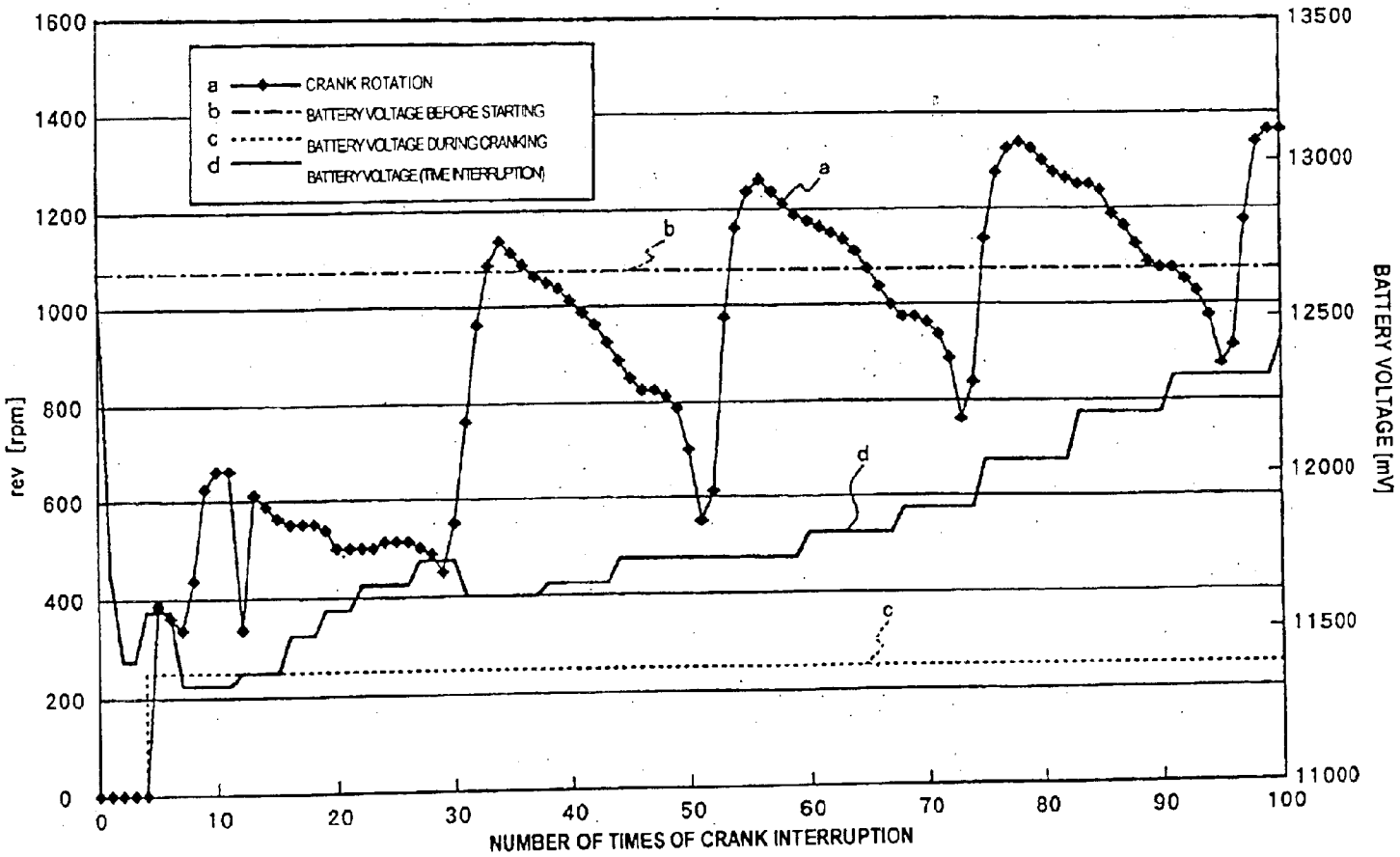
FIG. 4 is a graph of fluctuation of engine rotation and a battery voltage at the time of cell starting.
Figure 5:
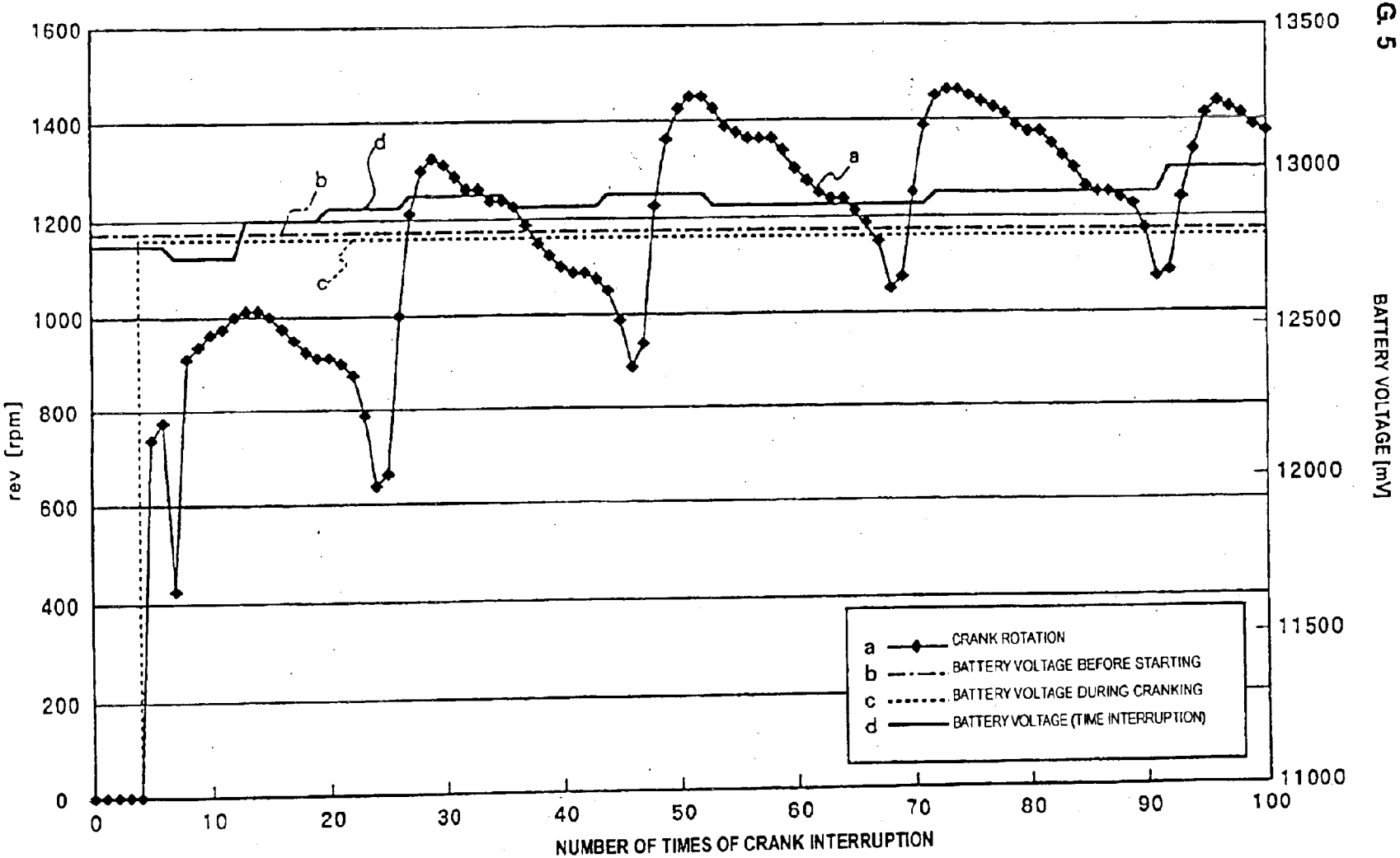
FIG. 5 is a graph of fluctuation of engine rotation and a battery voltage at the time of kick starting.

FIGS. 4 and 5 are graphs of fluctuation of crank rotation and a battery voltage at the time of cell starting and at the time of kick starting, respectively. The horizontal axis indicates the number of times of crank interruption corresponding to the number of crank pulse signals, "a" indicates fluctuation of crank rotation, "b" indicates battery voltage data at the time of engine stop, "c" indicates battery voltage data at the time of commencement of engine rotation, and "d" indicates actual change of battery voltage.

The battery voltage data "b" at the time of engine stop is the data detected and saves between time T1 and time T2 of FIG. 3 and is constant. The battery voltage data "c" at the time of commencement of engine rotation is the data detected and saved between time T4 and time T5 of FIG. 3 and is constant.

As it is seen from FIG. 4, in the case of the cell starting, since a battery voltage is supplied to the cell motor, voltage drop of the battery increases, and a difference between the battery voltage data "b" at the time of engine stop (before rotation) and the battery voltage data "c" at the time of commencement of engine rotation is large (in this example, approximately 1.3 V).

On the other hand, as it is seen from FIG. 5, in the case of the kick starting, since the battery is not used, there is almost no difference between the battery voltage data "b" at the time of engine stop (before rotation) and the battery voltage "c" at the time of commencement of engine rotation.

Figure 6:
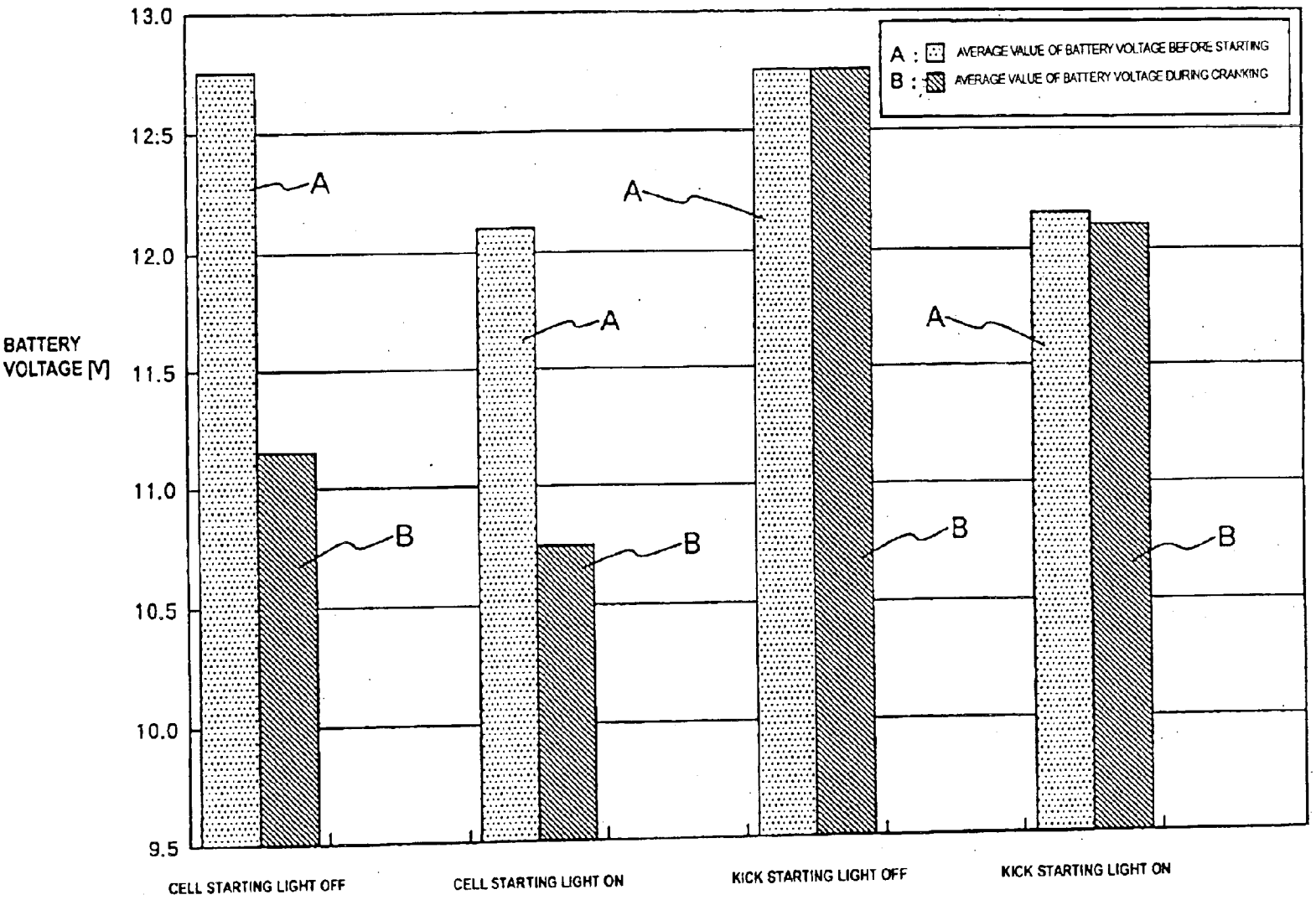
FIG. 6 is a graph of battery voltage average values before and after engine start of the cell starting and the kick starting.

FIG. 6 is a graph of battery voltage average values before engine start and during cranking of the cell starting and the kick starting. A battery voltage before engine start is the battery voltage at the time of engine stop and is the battery voltage between time T1 and time T2 of FIG. 3. A battery voltage during cranking is the battery voltage at the time of commencement of engine rotation and is the battery voltage between time T4 and time T5 of FIG. 3.

As it is seen from the figure, in the case of the cell starting, a difference between the battery voltages before engine start and during cranking is large. On the other hand, in the case of the kick starting, there is almost no difference of battery voltages before engine start and during cranking. Note that, as it is seen from the figure, voltage drop increases in the case of the cell starting regardless of ON/OFF of a light.

Figure 7:
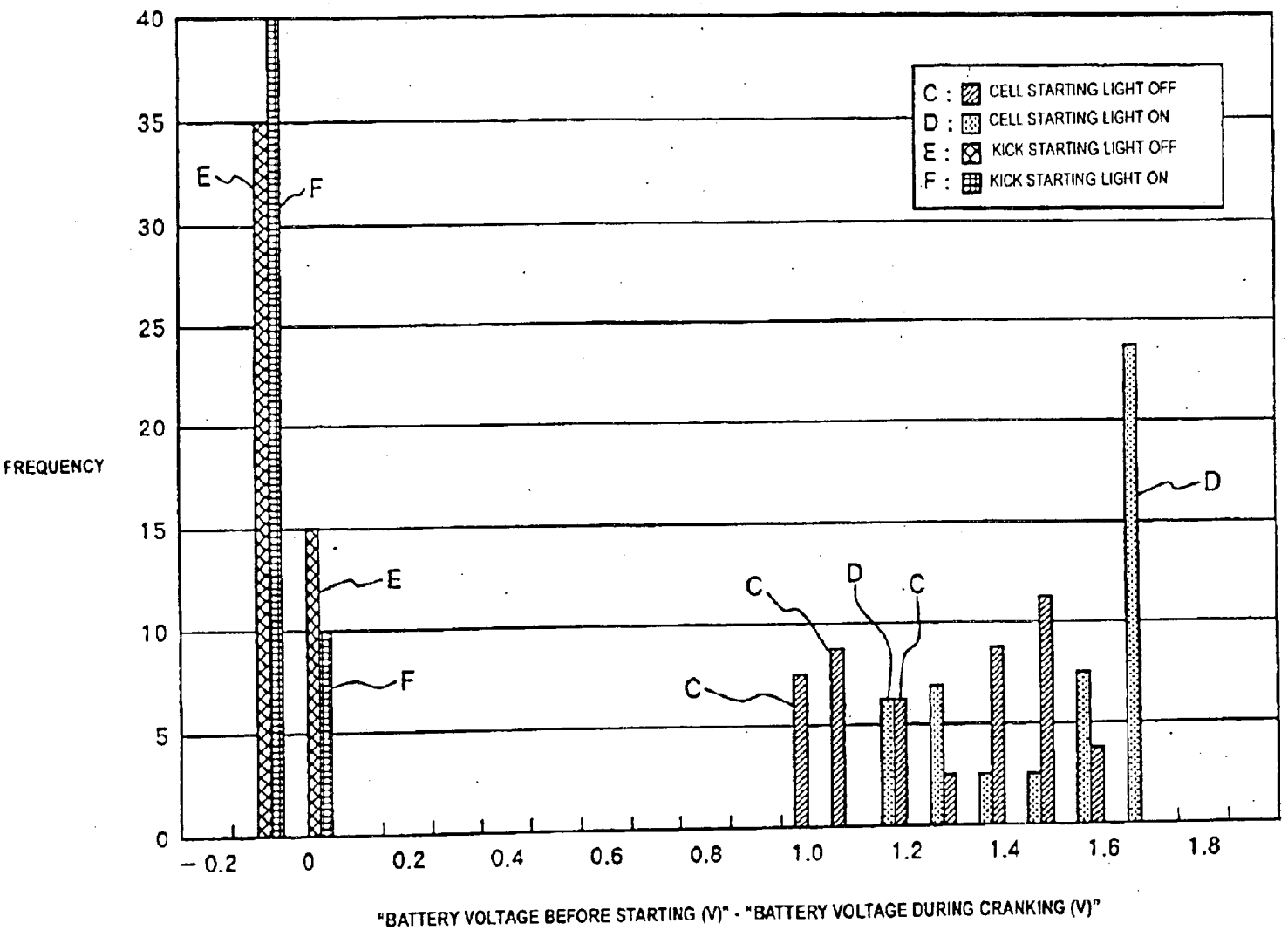
FIG. 7 is a distribution graph of battery voltage drop of the cell starting and the kick starting.

FIG. 7 is a graph showing frequency distribution of battery voltage drop before and after engine start.

As it is seen from the figure, in the case of the kick starting, a difference of battery voltages before engine start and during cranking is almost in the vicinity of zero (V) regardless of ON/OFF of a light. In the case of the cell starting, a difference of battery voltages before engine start and during cranking is 1 to 1.6 (V). Therefore, by judging a difference of voltages with the vicinity of 0.5 V as a threshold value, the kick starting and the cell starting can be distinguished.

Figure 8:
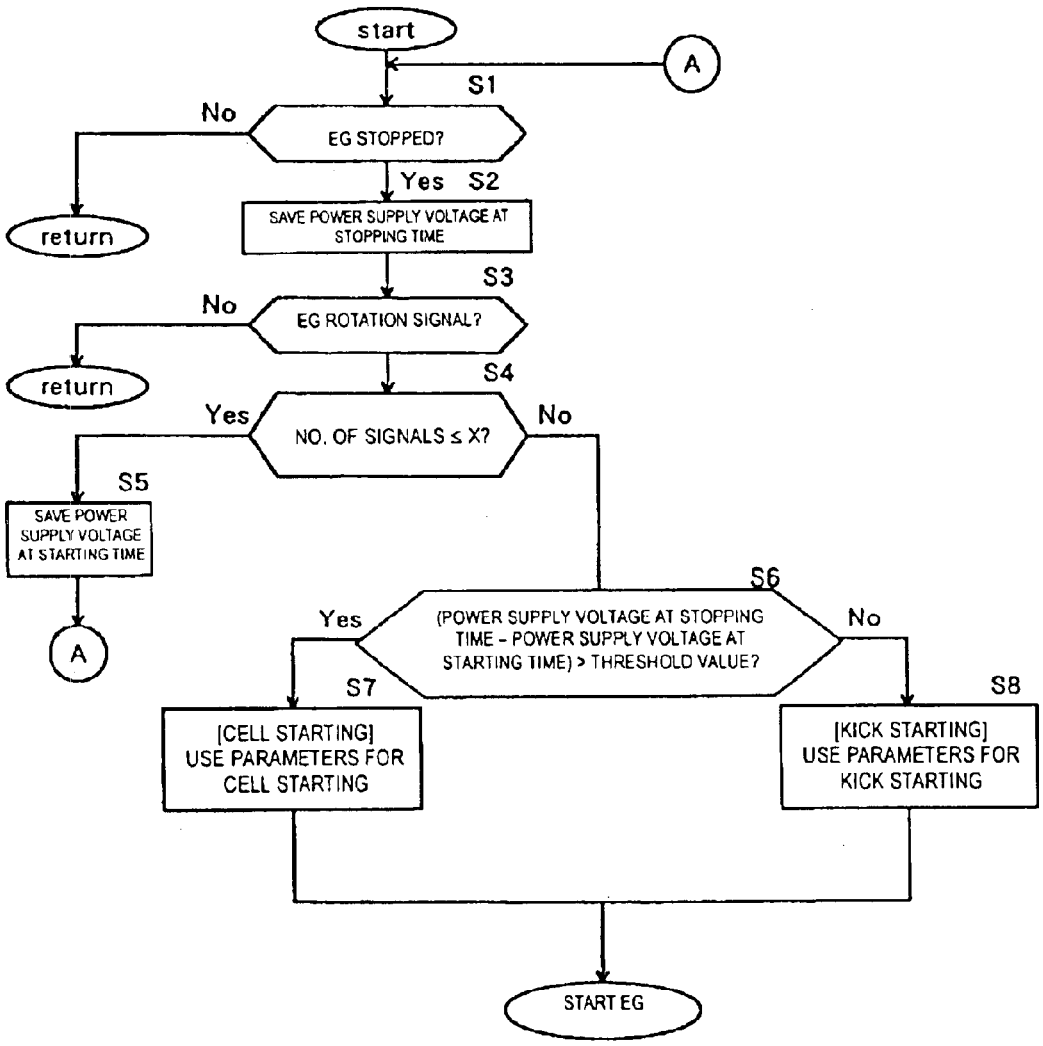
FIG. 8 is a flowchart showing an operation of an engine start control method of the present invention.

FIG. 8 is a flowchart showing an operation of an engine start control method by the ECU in accordance with the present invention.

Step S1: In a state in which the main switch is ON (see FIG. 3), the ECU judges whether the engine is rotating or is in a stopped state before rotation. If the engine is rotating, since it is not the time of start, the ECU exits the flow. Before engine rotation, that is, before the cell switch is turned ON, or before the kick lever is pressed, since the engine is stopped, the ECU proceeds to the next step S2.

Step S2: The ECU detects a battery voltage during preliminary driving of the fuel pump and saves the battery voltage.

Step S3: The ECU judges whether or not a crank pulse signal indicating rotation of the engine has been inputted to the ECU. This is for judging whether or not the engine has reached time T4 in the time chart of FIG. 3.

Step S4: The ECU judges whether or not the crank pulse signal is equal to or lower than a predetermined pulse x (e.g., three to five pulses). This is for judging whether or not the engine is between time T4 and time T5 in the time chart of FIG. 3.

Step S5: If the crank pulse signal is equal to or lower than the predetermined number of pulses in the above step S4, the ECU detects a battery voltage and saves the battery voltage as a voltage at the time of commencement of engine rotation.

Step S6: When the number of crank pulses has exceeded the predetermined number of pulses and the engine has come into a rotation state in which it is capable of carrying out self-explosion (i.e., has reached time T5), the ECU compares the battery voltage at the time of engine stop saved in step S2 and the battery voltage at the time of commencement of engine start saved in step S5 to judge whether or not the difference is larger than the threshold value. As shown in FIGS. 4 to 6, the difference of the battery voltages at the time of engine stop and at the time of commencement of engine start is larger in the cell starting than in the kick starting. This threshold value is set to, for example, about 0.5 V as explained in the description of FIG. 7.

Step S7: When the difference between the battery voltage at the time of engine stop and the battery voltage at the time of commencement of engine start is larger than the threshold value in step S6, the ECU performs fuel injection control and ignition time control suitable for the cell starting in accordance with a control program using a map according to parameters for cell starting set in advance.

Step S8: When the difference between the battery voltage at the time of engine stop and the battery voltage at the time of commencement of engine start is equal to or lower than the threshold value in step S6, the ECU performs fuel injection control and ignition time control suitable for the kick starting in accordance with a control program using a map according to parameters for the kick starting set in advance.

INDUSTRIAL APPLICABILITY

As described above, in the present invention, it can be judged, with a simple constitution, whether an engine is started by cell starting or kick starting according to a difference of battery voltage drop at the time when a cell motor is used at the time of engine start and in the case of the kick starting to select a cell starting program and a kick starting program according to the judgment and perform optimum engine start control in the respective cases.

What is claimed is:

1. An engine start control method, characterized by comprising: a cell starting program at the time of starting an engine with a cell motor; and a human power start program at the time of starting an engine with a human power, wherein the engine start control method detects a difference between a battery voltage at the time of engine stop and a battery voltage at the time of commencement of engine start, starts the engine in accordance with the cell starting program if this difference is larger than a predetermined value, and starts the engine in accordance with the human power start program if the difference is smaller than the predetermined value.

2. An engine start control method according to claim 1, characterized in that the engine start control method detects the battery voltage at the time of engine stop in a state before engine rotation to save the battery voltage, detects the battery voltage at the time of commencement of engine start when a crank pulse signal after engine rotation is equal to or lower than a predetermined number of pulses to save the battery voltage, and controls to drive the engine based upon a difference of the saved battery voltage data when the crank pulse signal has reached the predetermined pulse or more.

3. An engine start control apparatus for a fuel injection engine, characterized by comprising: a battery; a cell motor which is driven by an electric power from the battery; an injector for fuel injection; a fuel pump which supplies fuel to the injector; an ECU which controls to drive the engine at the time of commencement of engine start; a main switch intervened between the ECU and the battery; and a cell switch which drives the cell motor, a crank pulse signal being inputted to the ECU in accordance with engine rotation, and the ECU calculating an engine speed based upon this crank pulse after the crank pulse signal has exceeded a predetermined number of crank pulses after start of the engine rotation, the fuel pump being driven after the main switch is turned ON and before the engine rotation, and the ECU having a cell starting program at the time of starting the engine with the cell motor and a human power start program at the time of starting the engine with a human power, wherein the ECU judges whether the engine is to be started by the cell motor or a human power based upon the battery voltage to selectively use the cell starting program and the human power start program.

* * * * *